US010649371B2

(12) United States Patent
Saito et al.

(10) Patent No.: US 10,649,371 B2
(45) Date of Patent: May 12, 2020

(54) DEVELOPING DEVICE, PROCESS CARTRIDGE, AND IMAGE FORMING APPARATUS INCORPORATING SAME

(71) Applicants: Kei Saito, Kanagawa (JP); Yoshiyuki Fukuda, Tokyo (JP); Masaaki Yamada, Tokyo (JP); Yuuji Ishikura, Kanagawa (JP)

(72) Inventors: Kei Saito, Kanagawa (JP); Yoshiyuki Fukuda, Tokyo (JP); Masaaki Yamada, Tokyo (JP); Yuuji Ishikura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/298,401

(22) Filed: Mar. 11, 2019

(65) Prior Publication Data

US 2019/0286013 A1 Sep. 19, 2019

(30) Foreign Application Priority Data

Mar. 16, 2018 (JP) ..... 2018-049019

(51) Int. Cl.
*G03G 15/08* (2006.01)

(52) U.S. Cl.
CPC ..... *G03G 15/0891* (2013.01); *G03G 15/0812* (2013.01); *G03G 15/0886* (2013.01); *G03G 15/0889* (2013.01); *G03G 15/0893* (2013.01); *G03G 15/0881* (2013.01); *G03G 2215/0822* (2013.01); *G03G 2215/0827* (2013.01)

(58) Field of Classification Search
CPC ..... G03G 15/0812; G03G 15/0881; G03G 15/0882; G03G 15/0886; G03G 15/0889; G03G 15/0891
See application file for complete search history.

(56) References Cited

U.S. PATENT DOCUMENTS

2009/0238600 A1* 9/2009 Ito ..... G03G 15/0882 399/103
2012/0163874 A1 6/2012 Hattori et al.
2012/0219326 A1 8/2012 Koike et al.
2013/0034368 A1 2/2013 Hattori et al.
(Continued)

FOREIGN PATENT DOCUMENTS

JP 2007-041209 2/2007
JP 2010-217238 9/2010

*Primary Examiner* — David M. Gray
*Assistant Examiner* — Andrew V Do
(74) *Attorney, Agent, or Firm* — Duft & Bornsen, PC

(57) ABSTRACT

The developing device includes a developer bearer, a conveyor, a casing including a ceiling, and a seal. The developer bearer is configured to bear a developer and develop a latent image. The conveyor is configured to convey and stir the developer. The casing is configured to contain the developer, the developer bearer, and the conveyor. The seal is configured to seal the inside of the casing to form a closed space that encloses the developer in the developing device. The conveyor is configured to be partially or entirely buried in the developer enclosed in the closed space in both of a normal posture and an upside-down posture of the developing device. A cross-sectional area of the closed space in a horizontal plane gradually increases from a top of the ceiling of the casing toward a bottom of the developing device in the normal posture of the developing device.

8 Claims, 7 Drawing Sheets

(56) References Cited

U.S. PATENT DOCUMENTS

| | | | |
|---|---|---|---|
| 2013/0071147 | A1 | 3/2013 | Ogawa et al. |
| 2013/0071148 | A1 | 3/2013 | Ishikura et al. |
| 2013/0209143 | A1 | 8/2013 | Endou et al. |
| 2013/0216250 | A1 | 8/2013 | Seki et al. |
| 2013/0216276 | A1 | 8/2013 | Ogawa et al. |
| 2013/0216277 | A1 | 8/2013 | Endou et al. |
| 2013/0243499 | A1 | 9/2013 | Ishikura et al. |
| 2014/0112687 | A1 | 4/2014 | Ohmura et al. |
| 2014/0169827 | A1 | 6/2014 | Hattori et al. |
| 2014/0301747 | A1 | 10/2014 | Takahashi et al. |
| 2014/0356030 | A1 | 12/2014 | Fukuda et al. |
| 2015/0147094 | A1 | 5/2015 | Kadota et al. |
| 2015/0338824 | A1 | 11/2015 | Shimizu et al. |
| 2016/0062274 | A1 | 3/2016 | Kadota et al. |
| 2016/0238966 | A1 | 8/2016 | Oshikawa et al. |
| 2017/0108795 | A1 | 4/2017 | Oshikawa et al. |

* cited by examiner

DEVELOPING DEVICE, PROCESS CARTRIDGE, AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2018-049019, filed on Mar. 16, 2018, in the Japan Patent Office, the entire disclosure of which is hereby incorporated by reference herein.

BACKGROUND

Technical Field

This disclosure generally relates to a developing device to develop latent images formed on a surface of an image bearer, and a process cartridge including the developing device, and an image forming apparatus, such as a copier, a printer, a facsimile machine, or a multifunction peripheral (MFP) having at least two of such functions.

Description of the Related Art

An image forming apparatus, such as a copier, a printer, and the like, generally includes a developing device installable in and removable from the image forming apparatus. A new developing device previously stores (presets) a developer therein at factory shipment. There is a known technique of preventing the developer from leaking to the outside of the developing device during transport. In the technique, a seal that seals a space to store the developer as a closed space. The seal is detachably provided in the developing device.

SUMMARY

According to embodiments of the present disclosure, an improved developing device is installable in and removable from an image forming apparatus. The developing device includes a developer bearer opposed to an image bearer of the image forming apparatus, a conveyor, a casing including a ceiling, and a seal. The developer bearer is configured to bear a developer and develop a latent image formed on a surface of the image bearer. The conveyor is configured to convey and stir the developer contained in the developing device. The casing including the ceiling is configured to contain the developer, the developer bearer, and the conveyor. The seal detachable from the developing device is configured to seal the inside of the casing to form a closed space that encloses the developer in the developing device. The conveyor is configured to be partially or entirely buried in the developer enclosed in the closed space in both of a normal posture of the developing device and an upside-down posture of the developing device to which the developing device is flipped from the normal posture. A cross-sectional area of the closed space in a horizontal plane gradually increases from a top of the ceiling of the casing toward a bottom of the developing device in the normal posture of the developing device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
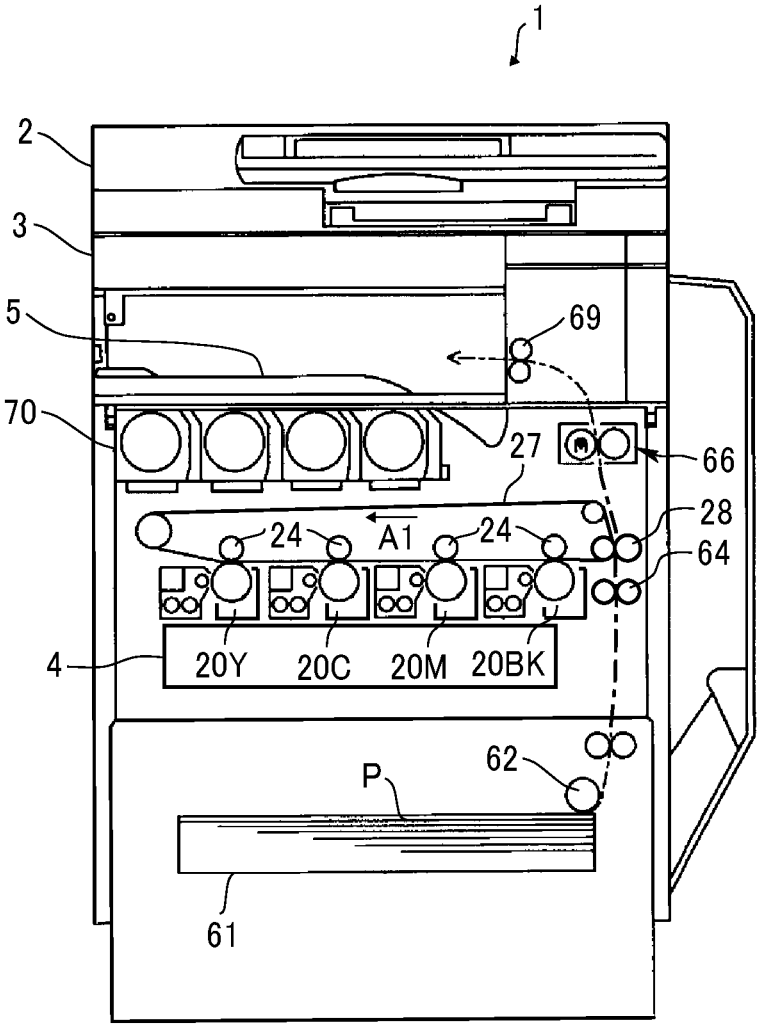
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, C, M and BK attached to each reference numeral indicate only that components indicated thereby are used for forming yellow, cyan, magenta, and black images, respectively, and hereinafter may be omitted when color discrimination is not necessary.

With reference to the drawings, embodiments of the present disclosure are described below. It is to be understood that identical or similar reference numerals are assigned to identical or corresponding components throughout the drawings, and redundant descriptions are omitted or simplified below as appropriate.

Now, a description is given of an overall configuration and operations of an image forming apparatus 1 according to an embodiment of the present disclosure, with reference to FIG. 1.

The image forming apparatus 1 according to the present embodiment is a tandem multicolor image forming apparatus in which process cartridges 20Y, 20C, 20M, and 20BK, serving as multiple image forming units, are arranged in parallel to each other, facing an intermediate transfer belt 27.

In FIG. 1, the image forming apparatus 1, which is a color copier in the present embodiment, includes a document conveying device 2, a document reading device 3, and a writing device (an exposure device) 4. The document conveying device 2 conveys an original document to the document reading device 3. The document reading device 3 reads image data of the original document. The writing device (the exposure device) 4 emits a laser beam based on the image data read by the document reading device 3.

The image forming apparatus 1 further includes the process cartridges 20Y, 20C, 20M, and 20BK, serving as the multiple image forming units for colors of yellow, cyan, magenta, and black, the intermediate transfer belt 27 on which toner images of multiple colors are transferred and superimposed, and a secondary transfer roller 28 to secondarily transfer the toner images on the intermediate transfer belt 27 onto a sheet P.

The image forming apparatus 1 further includes a sheet feeder (a sheet tray) 61 to accommodate the sheets P such as paper sheets, a fixing device 66 to fix unfixed toner images on the sheet P, and toner containers 70 to supply toners of respective colors to developing devices 23 (see FIG. 2) of the corresponding process cartridges 20Y, 20C, 20M, and 20BK.

Figure 2:
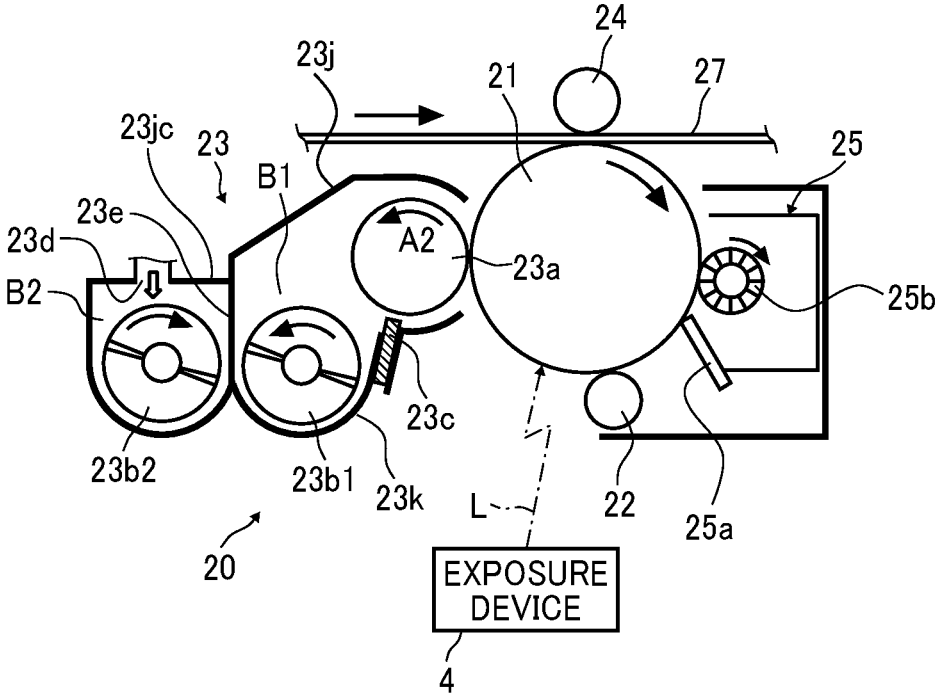
FIG. 2 is a schematic cross-sectional view of an image forming unit of the image forming apparatus in FIG. 1.

With Reference to FIG. 2, each of the process cartridges (the image forming units) 20Y, 20C, 20M, and 20BK includes a photoconductor drum 21 as an image bearer, a charging device 22, the developing device 23, and a cleaning device 25, which are united as a single unit. Each of the process cartridges 20Y, 20C, 20M, and 20BK that reaches the end of life is replaced with a new process cartridge in the image forming apparatus 1.

In the process cartridges 20Y, 20C, 20M, and 20BK, yellow, cyan, magenta, and black toner images are formed on the respective photoconductor drums (the image bearers) 21.

A description is provided below of operations of the image forming apparatus 1 to form a normal color toner image.

Conveyance rollers of the document conveying device 2 convey an original document on a document table onto an exposure glass of the document reading device 3. Then, the document reading device 3 optically reads image data of the original document on the exposure glass.

The yellow, cyan, magenta, and black image data are sent to the writing device (the exposure device) 4. The writing device 4 irradiates the photoconductor drums 21 (see FIG. 2) of the corresponding process cartridges 20Y, 20C, 20M, and 20BK with laser beams (exposure light) L based on the yellow, cyan, magenta, and black image data, respectively.

Meanwhile, the four photoconductor drums 21 rotate clockwise in FIGS. 1 and 2. A surface of the photoconductor drum 21 is uniformly charged at a position opposed to the charging device (a charging roller) 22 (a charging process). Thus, the surface of the photoconductor drum 21 is charged to a charging potential. When the charged surface of the photoconductor drum 21 reaches a position to receive the laser beam L emitted from the writing device 4, an electrostatic latent image based on the image data is formed on the surface of the photoconductor drum 21 (an exposure process).

The laser beam L corresponding to a yellow component is directed to the surface of the photoconductor drum 21 in the process cartridge 20Y, which is the first from the left in FIG. 1 among the four process cartridges 20Y, 20C, 20M, and 20BK. At that time, a polygon mirror rotates at a high speed to deflect the laser beam L corresponding to the yellow component in a direction of rotation axis of the photoconductor drum 21 (i.e., a main-scanning direction) so as to scan the photoconductor drum 21. Thus, an electrostatic latent image corresponding to the yellow component is formed on the photoconductor drum 21 charged by the charging device 22.

Similarly, the laser beam L corresponding to a cyan component is directed to the surface of the photoconductor drum 21 in the second process cartridge 20C from the left in FIG. 1, thus forming an electrostatic latent image corresponding to the cyan component on the surface of the photoconductor drum 21. The laser beam L corresponding to a magenta component is directed to the surface of the photoconductor drum 21 in the third process cartridge 20M from the left in FIG. 1, thus forming an electrostatic latent image corresponding to the magenta component on the surface of the photoconductor drum 21. The laser beam L corresponding to a black component is directed to the photoconductor drum 21 in the fourth process cartridge 20BK from the left in FIG. 1, thus forming an electrostatic latent image corresponding to the black component on the surface of the photoconductor drum 21.

Then, the surfaces of the photoconductor drums 21 having the respective electrostatic latent images reach positions opposed to the corresponding developing devices 23. Each developing device 23 supplies toner of the corresponding color to the photoconductor drum 21 to develop the latent image on the photoconductor drum 21 into a single-color toner image (a development process).

Subsequently, the surface of the photoconductor drum 21 after the development process reaches a position facing the intermediate transfer belt 27. Primary transfer rollers 24 are provided in contact with an inner circumferential surface of the intermediate transfer belt 27 at the opposing positions where the respective photoconductor drums 21 face the intermediate transfer belt 27. At positions of the primary transfer rollers 24, the single-color toner images on the respective photoconductor drums 21 are sequentially transferred and superimposed onto the intermediate transfer belt 27, thereby forming a multicolor toner image thereon (a primary transfer process).

After the primary transfer process, the surface of the photoconductor drum 21 reaches a position opposed to the cleaning device 25. The cleaning device 25 collects untransferred toner remaining on the photoconductor drum 21 (a cleaning process).

Subsequently, a residual potential of the surface of the photoconductor drum 21 is eliminated at a position opposed to a discharger, and a series of image forming processes performed on the photoconductor drum 21 is completed.

Meanwhile, the surface of the intermediate transfer belt 27, onto which the single-color toner images on the photoconductor drums 21 are superimposed, moves in the direction indicated by arrow A1 in FIG. 1 and reaches a position opposed to the secondary transfer roller 28. The secondary transfer roller 28 secondarily transfers the multicolor toner image on the intermediate transfer belt 27 to the sheet P (a secondary transfer process).

After the secondary transfer process, the surface of the intermediate transfer belt 27 reaches a position opposed to a belt cleaner. The belt cleaner collects untransferred toner on the intermediate transfer belt 27, and a series of transfer processes on the intermediate transfer belt 27 is completed.

The sheet P is conveyed to the position of the secondary transfer roller 28, via the registration roller pair 64 from the sheet feeder 61.

More specifically, a sheet feed roller 62 feeds the sheet P from the top of multiple sheets P accommodated in the sheet feeder 61, and the sheet P is conveyed to a registration roller pair 64 through a sheet feed path. The sheet P that has reached the registration roller pair 64 is conveyed toward the position of the secondary transfer roller 28, timed to coincide with the multicolor toner image on the intermediate transfer belt 27.

Subsequently, the sheet P, onto which the multicolor toner image is transferred, is conveyed to the fixing device 66. The fixing device 66 includes a fixing roller and a pressure roller pressing against each other. In a nip between the fixing roller and the pressure roller, the multicolor toner image is fixed on the sheet P.

After the fixing process, an output roller pair 69 ejects the sheet P as an output image outside the image forming apparatus 1, and the ejected sheet P is stacked on an output tray 5. Thus, a series of image forming processes is completed.

Next, the image forming units of the image forming apparatus 1 are described in further detail below with reference to FIGS. 2 and 3.

The four image forming units installed in the image forming apparatus 1 have a similar configuration except the color of the toner used in the image forming processes. Therefore, the process cartridge and components thereof are illustrated without suffixes Y, C, M, and BK, which denote the color of the toner, in the drawings.

As illustrated in FIG. 2, the process cartridge 20 mainly includes the photoconductor drum 21 as the image bearer, the developing device 23, the charging device 22, and the cleaning device 25, which are stored in a housing of the process cartridge 20 as a single unit.

The cleaning device 25 includes a cleaning blade 25*a* and a cleaning roller 25*b* that contact the photoconductor drum 21.

The developing device 23 mainly includes a developing roller 23*a* as a developer bearer, a first conveying screw 23*b*1 as a first conveyor, a second conveying screw 23*b*2 as a second conveyor, a partition 23*e*, and a doctor blade 23*c* as a developer regulator. The developing roller 23*a* is opposed to the photoconductor drum 21 to form a development range. The first conveying screw 23*b*1 is opposed to the developing roller 23*a*. The second conveying screw 23*b*2 is opposed to the first conveying screw 23*b*1 via the partition 23*e*. The doctor blade 23*c* is opposed to the developing roller 23*a* to regulate an amount of developer G borne on the developing roller 23*a*.

The developing device 23 stores a two-component developer G including carrier and toner.

The developing roller 23*a* is opposed to the photoconductor drum 21 with a small gap, thereby forming the development range. The developing roller 23*a* includes stationary magnets 23*a*1 inside the developing roller 23*a* and a sleeve 23*a*2 that rotates around the magnets 23*a*1 as illustrated in FIG. 3. The magnets generate multiple poles (magnetic poles) around an outer circumferential surface of the developing roller 23*a*.

Figure 3:
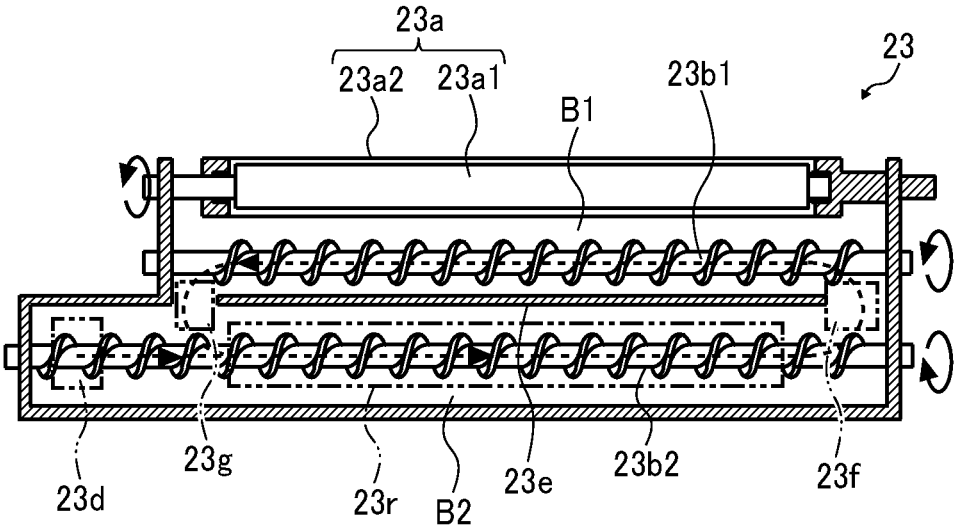
FIG. 3 is a schematic cross-sectional view of a developing device of the image forming unit in FIG. 2 as viewed along a longitudinal direction of the developing device.

The first and second conveying screws 23*b*1 and 23*b*2 as conveyors convey the developer G stored in the developing device 23 in a longitudinal direction of the developing device 23, thereby establishing a circulation path indicated by the dashed arrow in FIG. 3. That is, the first conveying screw 23*b*1 establishes a first conveyance path B1, and the second conveying screw 23*b*2 establishes a second conveyance path B2. The circulation path of the developer G is composed of the first and second conveyance paths B1 and B2.

The partition (an inner wall) 23*e* separates the first conveyance path B1 from the second conveyance path B2, and the first and second conveyance paths B1 and B2 communicate with each other via first and second communication openings 23*f* and 23*g* disposed at both ends of the first and second conveyance paths B1 and B2. Specifically, with reference to FIG. 3, an upstream end of the first conveyance path B1 communicates with a downstream end of the second conveyance path B2 via the first communication opening 23*f* A downstream end of the first conveyance path B1 communicates with an upstream end of the second conveyance path B2 via the second communication opening 23*g*. That is, the partition 23*e* is disposed along the circulation path in the longitudinal direction of the developing device 23 except both ends of the circulation path.

The first conveying screw 23*b*1 (the first conveyance path B1) is opposed to the developing roller 23*a*, and the second conveying screw 23*b*2 (the second conveyance path B2) is opposed to the first conveying screw 23*b*1 (the first conveyance path B1) via the partition 23*e*. The first conveying screw 23*b*1 supplies the developer G to the developing roller 23*a* while conveying the developer Gin the longitudinal direction of the developing device 23 and collects a part of the developer G that separates from the developing roller 23*a* after the development process. The second conveying screw 23*b*2 stirs and mixes the developer G after the development process conveyed from the first conveyance path B1 with a fresh developer G supplied from a supply port 23*d* while conveying the developer G in the longitudinal direction of the developing device 23.

In the present embodiment, the first and second conveying screws 23*b*1 and 23*b*2 as the conveyors are horizontally arranged in parallel. Each of the first and second conveying screws 23*b*1 and 23*b*2 includes a shaft and a screw blade wound around the shaft.

A further detailed description is given of the image forming processes described above, focusing on the development process.

The developing roller 23*a* rotates counterclockwise as indicated by arrow A2 in FIG. 2. As illustrated in FIG. 3, as the first and second conveying screws 23*b*1 and 23*b*2, between which the partition 23*e* is interposed, rotate in directions indicated by arrows in FIGS. 2 and 3, the developer G in the developing device 23 is stirred and mixed with toner supplied from the toner container 70 via a toner supply path and the supply port 23*d* while circulated in the longitudinal direction of the developing device 23 indicated by the dashed arrow in FIG. 3.

The toner is charged by friction with carrier in the developer G and electrostatically attracted to the carrier. Then, the toner is scooped up on the developing roller 23*a* together with the carrier by a developer scooping pole generated on the developing roller 23*a*. The developer G carried on the developing roller 23*a* is conveyed in the counterclockwise direction indicated by arrow A2 in FIG. 2 to a position opposed to the doctor blade 23*c*. At this position, the doctor blade 23*c* adjusts an amount of the developer G on the developing roller 23*a*. Then, the developer G is conveyed to the development range opposed to the photoconductor drum 21. The toner in the developer G is attracted to the latent image formed on the photoconductor drum 21 due to an effect of an electric field generated in the development range. As the sleeve rotates, the developer G remaining on the developing roller 23*a* reaches above the first conveyance path B1 and separates from the developing roller 23*a*. The electric field in the development range is formed by a predetermined voltage (a development bias) applied to the developing roller 23*a* by a development power supply and a surface potential (a latent image potential) formed on the photoconductor drum 21 in the charging process and the exposure process.

The toner stored in the toner container 70 is supplied through the supply port 23*d* to the developing device 23 as the toner in the developing device 23 is consumed. The toner consumption in the developing device 23 is detected by a toner concentration sensor that magnetically detects toner concentration in the developer G (i.e., a ratio of toner to the developer G) in the developing device 23.

The supply port 23*d* is disposed above the second conveying screw 23*b*2 (the second conveyance path B2) at an end of the second conveying screw 23*b*2 in the longitudinal direction (the left and right direction in FIG. 3). In comparison between FIG. 2 and FIG. 4, a portion of a ceiling 23*jc* with the supply port 23*d* formed therein is disposed lower than the other portion of the ceiling 23*jc*.

With reference to FIGS. 4 to 6B, distinctive configuration and operation of the developing device 23 according to the present embodiment are described in further detail below.

As described above with reference to FIGS. 2 and 3, the developing device 23 (the process cartridge 20) according to the present embodiment is installable in and removable from the image forming apparatus 1.

The developing device 23 includes the developing roller (the developer bearer) 23*a* and the first and second conveying screws 23*b*1 and 23*b*2 as the conveyors. The developing roller 23*a* is opposed to the photoconductor drum (the image bearer) 21 and bears the developer G. The first and second conveying screws 23*b*1 and 23*b*2 convey and stir the developer G contained in the developing device 23. In the present embodiment, a casing of the developing device 23 that contains the developer G, the developing roller 23*a* as the developer bearer, and the first and second conveying screws 23*b*1 and 23*b*2 as the conveyors can be divided into an upper casing 23*j* and a lower casing 23*k* in the vertical direction. The developing roller 23*a* and the first and second conveying screws 23*b*1 and 23*b*2 are rotatably supported by the lower casing 23*k*.

The developing device 23 according to the present embodiment includes first and second seals 23*s* and 23*t* as seals (see FIGS. 6A and 6B) to seal a space that contains the developer G inside the developing device 23 to form a closed space S composed of the first and second conveyance paths B1, B2 and an upper space C. The first and second seals 23*s* and 23*t* are detachable from the developing device 23.

Figure 6A:
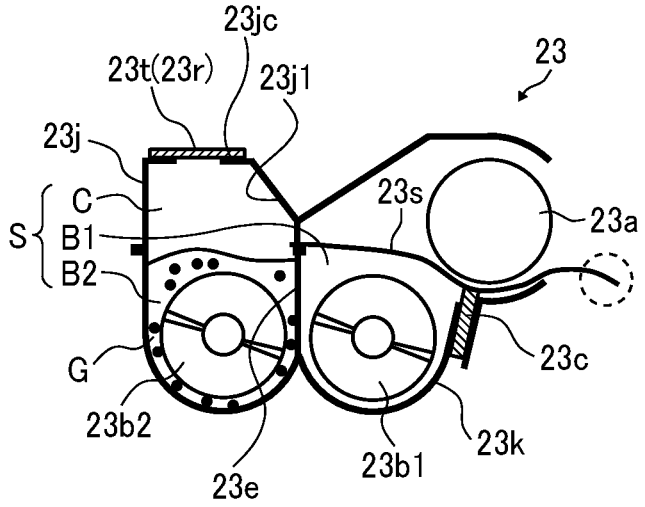
FIG. 6A is a schematic cross-sectional view of the developing device in a normal posture at factory shipment.
Figure 6B:
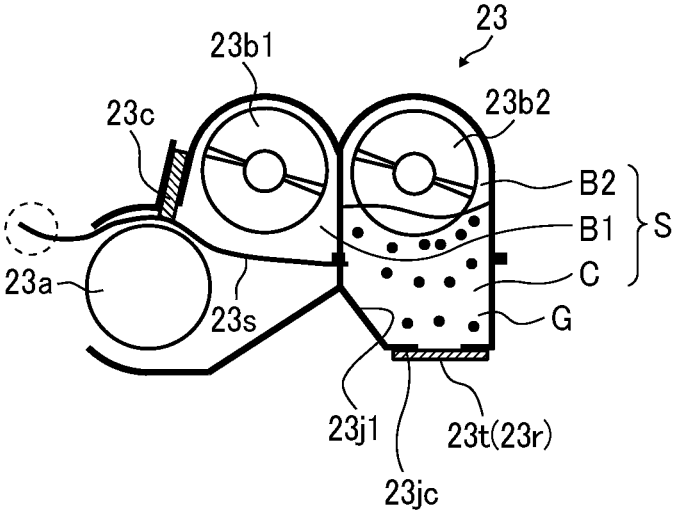
FIG. 6B is a schematic cross-sectional view of the developing device in an upside-down posture at factory shipment.

With reference to FIGS. 6A and 6B, the closed space S are an approximately enclosed space that previously contains the developer G inside the developing device 23. Hereinafter, the developer G previously contained in the developing device 23 is also referred to as "a preset developer G".

Figure 4:
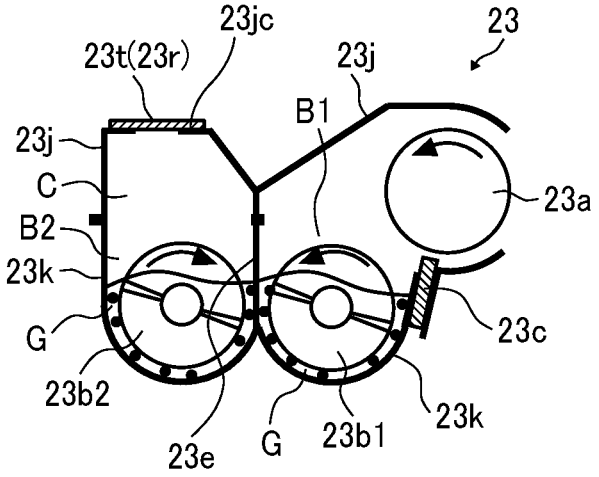
FIG. 4 is a schematic cross-sectional view of the developing device in operation in the image forming apparatus.
Figure 5:
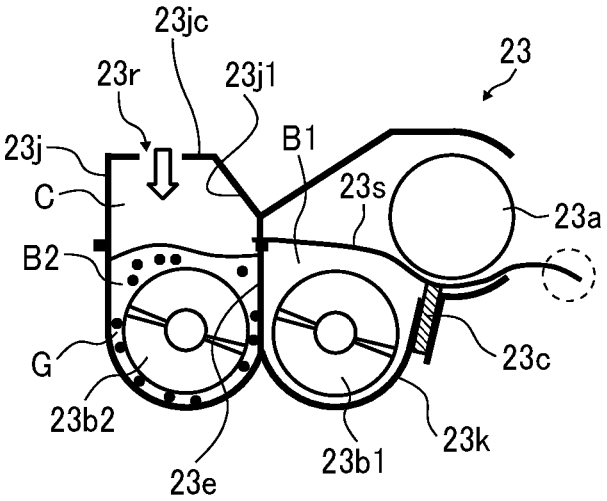
FIG. 5 is a schematic cross-sectional view of the developing device filled with a preset developer during manufacturing.

Specifically, as illustrated in FIGS. 4, 5, and 6A, the developing device 23 has an upper space C disposed above the second conveyance path B2 in which the second conveying screw (the second conveyor) 23*b*2 is provided. The ceiling 23*j* c above the upper space C has an opening 23*r* extending in the longitudinal direction of the developing device 23 (i.e., the left and right direction in FIG. 3 and the direction perpendicular to the surface of the paper on which FIGS. 4 to 6B are drawn). The developing device 23 is filled with the preset developer (the developer) G through the opening 23*r* during manufacturing. That is, the opening 23*r* functions as a filling port through which the preset developer G is poured to the developing device 23, and the upper space C functions as a space for presetting.

More specifically, as illustrated in FIG. 4, when the developing device 23 is installed in the image forming apparatus 1 and operates, the first seal 23*s* (see FIGS. 5, 6A, and 6B) is detached from the developing device 23, and the opening (the filling port for the preset developer G) 23*r* is sealed by the second seal 23*t*. As a result, the development process (the image forming process) described above with reference to FIG. 2 is performed without leaking of the developer G from the opening 23*r*.

At a manufacturing factory, as illustrated in FIG. 5, the developer (the preset developer) G is poured from the opening 23*r* toward the second conveyance path B2 via the upper space C as indicated by the white arrow in FIG. 5, in a state in which the first seal 23*s* is attached to the developing device 23 after assembly of the developing device 23. At that time, the first and second conveying screws 23*b*1 and 23*b*2 are (or the developing device 23 is) not driven. Then, the opening 23*r* is sealed by the second seal 23*t*, and the closed space S, which is composed of the first and second conveyance paths B1, B2 and the upper space C, is formed as illustrated in FIG. 6A. In this state, the developing device 23 (the process cartridge 20) is shipped singly or in a state in which the developing device 23 is installed in the image forming apparatus 1.

When the developing device 23 starts to be used in the image forming apparatus 1, a user or a service person detaches the first seal 23*s* from the developing device 23. Thus, the normal image forming processes start as described above with reference to FIG. 5.

The first seal 23*s* is a thin sheet having flexibility and made of a resin material such as polyethylene terephthalate (PET). The first seal 23*s* seals between the developing roller 23*a* and the first conveyance path B1. Specifically, as illustrated in FIG. 5, the first seal 23*s* is sandwiched and lightly adhered between the upper casing 23*j* and the lower casing 23*k*. One end of the first seal 23*s* protrudes forward of the developing device 23 as indicated by the dashed circle in FIG. 5. An operator such as a user grips and pulls out the protruding portion of the first seal 23*s* to the right in FIG. 5, thereby detaching the first seal 23*s* from the developing device 23.

The second seal 23*t* is a slightly thick sheet made of the resin material. The second seal 23*t* seals the opening 23*r* after the developing device 23 has been filled with the preset developer G.

Since the first seal 23*s* and the second seal 23*t* are provided in the developing device 23, the closed space S composed of the first conveyance path B1, the second conveyance path B2, and the upper space C is formed to contain the preset developer (the developer) G.

As described above with reference to FIG. 5, the preset developer G is poured from the opening 23*r* toward the second conveyance path B2 via the upper space C without rotating the first and second conveying screws 23*b*1 and 23*b*2 at the manufacturing factory. Since the first and second conveyance paths B1 and B2 communicate with each other only via the first and second communication openings 23*f* and 23*g*, the first conveyance path B1 is not aggressively filled with the preset developer G as illustrated in FIG. 6A.

Thus, the closed space S, which is composed of the first conveyance path B1, the second conveyance path B2, and the upper space C, is formed and stores the preset developer (the developer) G. Therefore, an inconvenience that the developer G leaks from the developing device 23 during transport after factory shipment is prevented.

Further, the first seal 23*s* is disposed between the developing roller 23*a* and the first conveyance path B1, thereby preventing the preset developer G from adhering to the developing roller 23*a*. Therefore, since the preset developer G does not adhere to the developing roller 23*a*, the developing roller 23*a* does not abrade, and toner does not stick to the developing roller 23*a*.

In the present embodiment, as described above with reference to FIG. 5, the preset developer G is poured into the developing device 23 through the opening 23*r*, not through the supply port 23*d*. The opening 23*r* is disposed extending above the second conveyance path B2 via the upper space C in the longitudinal direction of the developing device 23. The supply port 23*d* is disposed at the end of the developing device 23 in the longitudinal direction. Therefore, the preset developer G can be poured toward the second conveyance path B2 by the own weight without driving the first and second conveying screws 23*b*1 and 23*b*2. The preset developer G is the developer with required amount for the development process. At that time, the upper space C, which is disposed above the second conveyance path B2, is large enough to contain the preset developer G. Therefore, the preset developer G does not overflow from the second conveyance path B2 (the developing device 23).

Thus, the developing device 23 is filled with the preset developer G without driving the first and second conveying screws 23*b*1 and 23*b*2. Therefore, the first seal 23*s* is not entangled with first conveying screw 23*b*1 or the developing roller 23*a*. Further, special jigs for driving the developing device 23 are not required, and it does not take time or effort for an operator to manually rotate the first and second conveying screws 23*b*1 and 23*b*2. Therefore, workability of pouring the preset developer G into the developing device 23 is improved, and filling time is shortened.

FIG. 6A is a schematic cross-sectional view of the developing device 23 in a normal posture. FIG. 6B is a schematic cross-sectional view of the developing device in an upside-down posture. In the developing device 23 according to the present embodiment, the preset developer (the developer) G is contained in the closed space S that is formed by the first and second seals 23*s* and 23*t* and composed of the first and second conveyance paths B1 and B2 and the upper space C. The second conveying screw (the conveyor) 23*b*2 is partially or entirely buried in the preset developer G in both of the normal posture and the upside-down posture.

Specifically, in the present embodiment, the entire second conveying screw 23*b*2 is buried in the preset developer G as illustrated in FIG. 6A when the developing device 23 is in the normal posture. At that time, a surface level of the preset developer G is near the upper end of the second conveyance path B2 or reaches the upper space C beyond the second conveyance path B2.

On the other hand, a part of the second conveying screw 23*b*2 is buried in the preset developer G as illustrated in FIG. 6B when the developing device 23 is in the upside-down posture. The second conveying screw 23*b*2 is disposed in contact with the preset developer G. At that time, the surface level of the preset developer G reaches the second conveyance path B2 from the upper space C which is upside-down.

A state illustrated in FIG. 6B, in which the developing device 23 (the process cartridge 20) is upside-down, is likely to occur when the developing device 23 (the process cartridge 20) is singly packed as a service part, and transported or stored, not when the developing device 23 (the process cartridge 20) is installed in the image forming apparatus 1.

In the developing device 23 according to the present embodiment, as illustrated in FIG. 6A, the closed space S gradually spreads from a top of the ceiling 23*jc* of the closed space S toward a bottom of the developing device 23 in the normal posture. The closed space S is composed of the first and second conveyance paths B1 and B2 and the upper space C.

Specifically, in the state in which the developing device 23 is in the normal posture, a part or all of the ceiling 23*jc* that encloses the closed space S is inclined (i.e., has an inclined surface 23*j*1). The inclined surface 23*j*1 is provided so that a width of the closed space S in a transverse direction of the developing device 23 (i.e., the left and right direction in FIG. 6A) gradually increases from the top of the ceiling 23*j* c of the closed space S toward the bottom of the developing device 23.

In the present embodiment, the closed space S includes the upper space C disposed above the second conveyance path B2. The inclined surface 23*j*1 defines an upper end of the upper space C.

Specifically, as illustrated in FIG. 6A, the inclined surface 23*j*1 is provided so that a space (a cross-sectional area of the space in a horizontal plane) expands from the top toward the bottom. The present embodiment is different from an example in FIG. 7A, in which a space is covered on all four sides with vertical surfaces and has a constant cross-sectional area (a constant space). Further, the inclined surface 23*j*1 is not provided so that a space (the cross-sectional area of the space in the horizontal plane) narrows from the top toward the bottom. In the present embodiment, as illustrated in FIG. 6A, a portion of the ceiling 23*j*c of the upper casing 23*j* that defines the upper end of the upper space C includes the inclined surface 23*j*1 on the side close to the first conveyance path B1 in the transverse direction of the developing device 23 (i.e., the left and right direction in FIG. 6A). The inclined surface 23*j*1 is a wall surface that slopes in a direction approaching the first conveyance path B1 from the top toward the bottom, and the other wall surface is vertical.

After arrival of the developing device 23 to a user, the first seal 23*s* is detached from the developing device 23 to use the developing device 23 in the image forming apparatus 1. With the above-described configuration, if the preset developer G agglomerates in the closed space S due to temperature and humidity conditions during transport or storage, an inconvenience that the preset developer G is not entirely distributed inside the developing device 23 is prevented.

Figure 7A:
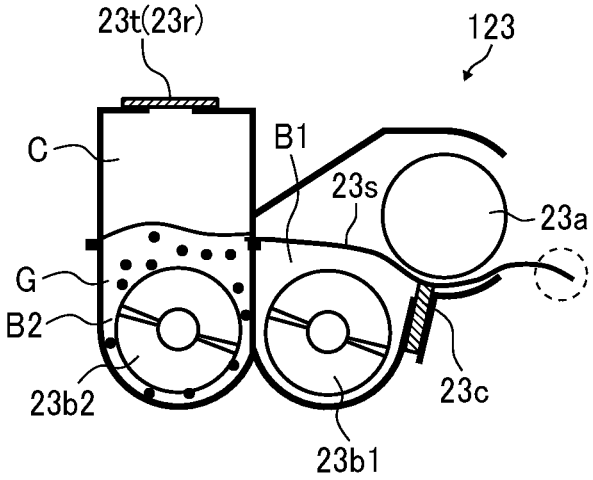
FIG. 7A is a schematic cross-sectional view of a developing device in a normal posture at factory shipment according to a comparative example.
Figure 7B:
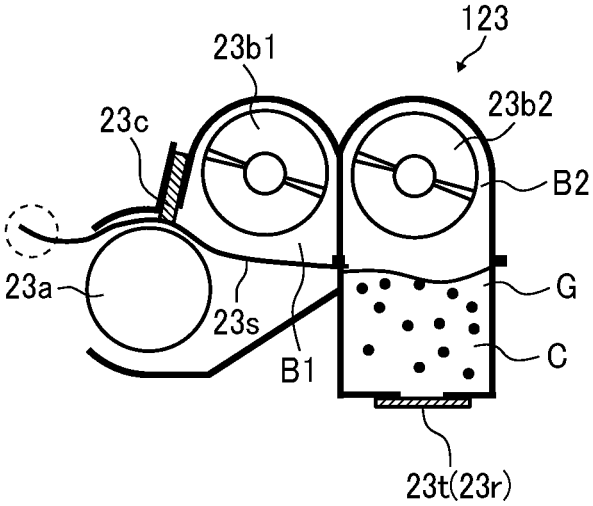
FIG. 7B is a schematic cross-sectional view of the developing device in an upside-down posture at factory shipment according to the comparative example.

In a developing device 123 as a comparative example illustrated in FIGS. 7A and 7B, the second conveying screw 23*b*2 is not in contact with the preset developer G in the upside-down posture illustrated in FIG. 7B. After the preset developer G agglomerates in the closed space S in the normal posture illustrated in FIG. 7A, as the developing device 123 starts to be driven, the second conveying screw 23*b*2 buried in the preset developer G stirs the agglomerated preset developer G, thereby resolving the agglomeration of the preset developer G. When the preset developer G agglomerates in the closed space S in the upside-down posture of the developing device 123 illustrated in FIG. 7B, if the developing device 123 is flipped from the upside-down posture to the normal posture and starts to be driven, the agglomeration of the preset developer G is not resolved by stirring with the second conveying screw 23*b*2 because the preset developer G agglomerates in the upside-down posture in which the second conveying screw 23*b*2 is not contact with the preset developer G.

The developing device 123 as the comparative example does not include an inclined surface above the upper space C, differing from the present embodiment. Therefore, if the developing device 123 is flipped from the upside-down posture illustrated in FIG. 7B to the normal posture illustrated in FIG. 7A, the preset developer G agglomerated in the upper space C hardly falls on the second conveyance path B2.

On the other hand, in the developing device 23 according to the present embodiment, after the preset developer G agglomerates in the normal posture illustrated in FIG. 6A, as the developing device 23 starts to be driven, the second conveying screw 23*b*2 buried in the preset developer G stirs the agglomerated preset developer G, thereby resolving the agglomeration of the preset developer G as a matter of course. If the preset developer G agglomerates in the upside-down posture of the developing device 23 illustrated in FIG. 6B, the preset developer G is in contact with the second conveying screw 23*b*2. Therefore, as the developing device 23 is flipped from the upside-down posture to the normal posture and starts to be driven, the second conveying screw 23*b*2 stirs the agglomerated preset developer G, thereby gradually resolving the agglomeration of the preset developer G. A shape of the upper casing 23*j* that defines the upper space C is designed so that the second conveying screw 23*b*2 is buried in the preset developer G to a predetermined position in the upside-down posture of the developing device 23.

The developing device 23 according to the present embodiment includes the inclined surface 23*j*1 that defines the upper space C serving as the space for presetting. When the developing device 23 is flipped from the upside-down posture illustrated in FIG. 6B to the normal posture illustrated in FIG. 6A, the preset developer G agglomerated in the upper space C easily falls on the second conveyance path B2.

Thus, the preset developer G agglomerated in the closed space S is stirred by the second conveying screw 23*b*2 and gradually collapsed, thereby recovering normal flowability. Accordingly, the preset developer G is entirely circulated inside the developing device 23 by the first and second conveying screws 23*b*1 and 23*b*2. Therefore, the occurrence of abnormal images can be minimized, such as reduction in image density caused when the developer G is not sufficiently circulated in the developing device 23.

Figure 8:
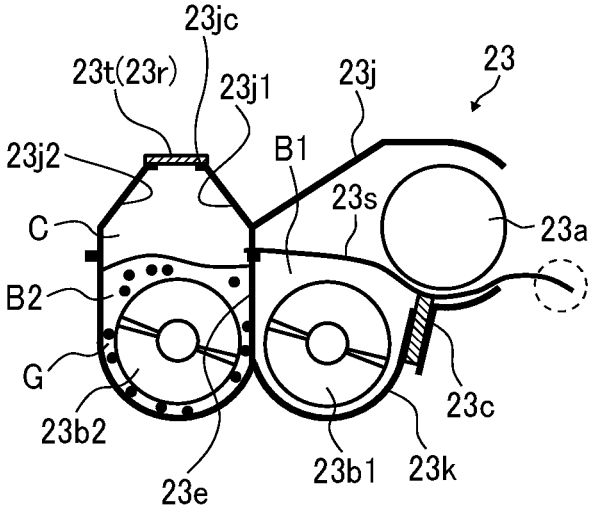
FIG. 8 is a schematic cross-sectional view of a developing device in a normal posture at factory shipment according to a first variation.

FIG. 8 illustrates a developing device 23 in the normal posture according to a first variation at factory shipment and corresponds to FIG. 6A in the above-described embodiment.

As illustrated in FIG. 8, in the developing device 23 according to the first variation, a portion of the ceiling 23*j*c of the upper casing 23*j* that defines the upper end of the upper space C includes, in addition to the inclined surface 23*j*1 on the side close to the first conveyance path B1 in the transverse direction of the developing device 23 (i.e., the left and right direction in FIG. 8), an inclined surface 23*j*2 on the other side. The inclined surface 23*j*2 slopes in a direction away from the first conveyance path B1 from the top toward the bottom.

With such a configuration, when the developing device 23 is flipped from the upside-down posture to the normal posture, the preset developer G agglomerated in the upper space C more easily falls on the second conveyance path B2.

In the first variation and the above-described embodiment, the inclined surfaces are each disposed at an end portion in the transverse direction of the developing device 23. Alternatively, the inclined surfaces can be disposed at end portions in the longitudinal direction of the developing device 23.

Further, wall surfaces on all four sides that define the upper space C can be inclined surfaces. In such a case, in the state in which the developing device 23 is in the normal posture, all of the ceiling that encloses the upper space C (the closed space S) is inclined (i.e., has inclined surfaces). The inclined surfaces are provided so that the cross-sectional area of the closed space in the horizontal plane increases from the top toward the bottom.

Figure 9:
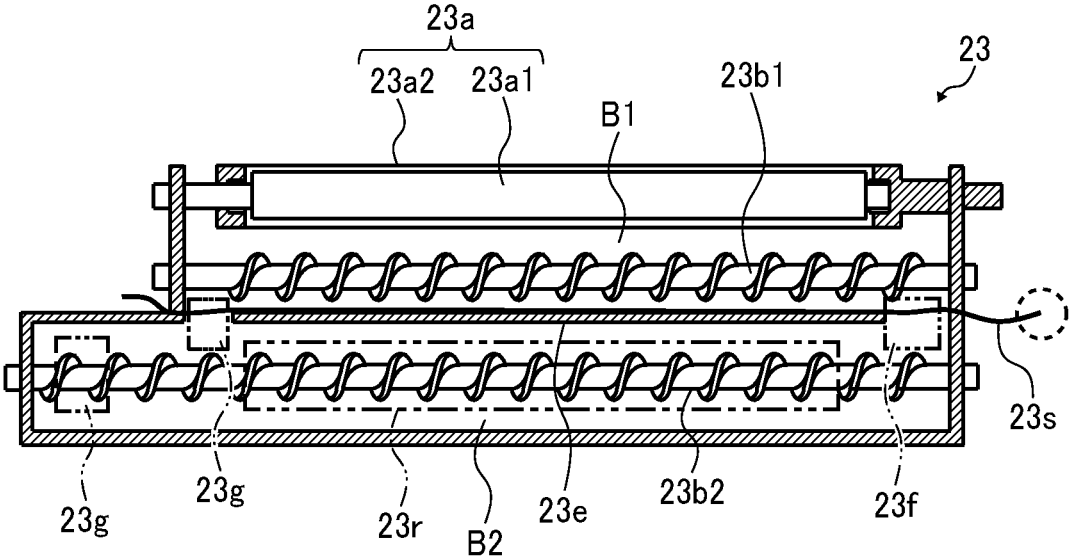
FIG. 9 is a schematic cross-sectional view of a developing device to which a first seal is attached according to a second variation, as viewed along the longitudinal direction of the developing device.

FIG. 9 is a schematic cross-sectional view of a developing device 23 to which a first seal 23*s* according to a second variation is attached, as viewed along the longitudinal direction of the developing device 23 and corresponds to FIG. 3 in the above-described embodiment.

As illustrated in FIG. 9, in the developing device 23 to contain the preset developer G according to the second variation, the first seal 23*s* seals the first and second communication openings 23*f* and 23*g* by which the first and second conveyance paths B1 and B2 communicate with each other. The first seal 23*s* is a sheet, and an end of the first seal 23*s* protrudes from a side face of the developing device 23. After arrival of the developing device 23 to a user, the end of the first seal 23*s* indicated by the dashed circle in FIG. 9 is pulled out, thereby detaching the first seal 23*s* from the developing device 23.

With such a configuration, the first and second seals 23*s* and 23*t* form a closed space S composed of the second conveyance path B2 and the upper space C.

With such a configuration, similar effects to those of the embodiments described above are also attained. That is, the first seal 23*s* is detached to use the developing device 23. At that time, if the preset developer G agglomerates in the closed space S, as the developing device 23 starts to be driven, the second conveying screw 23*b*2 resolves the agglomeration of the preset developer G. As a result, the preset developer G is entirely circulated inside the developing device 23 by the first and second conveying screws 23*b*1 and 23*b*2.

In particular, in the second variation, since the preset developer G is contained in the closed space S composed of the second conveyance path B2 and the upper space C, the preset developer G does not move from the second conveyance path B2 to the first conveyance path B1. Accordingly, whatever the posture of the developing device 23 is, the surface level of the preset developer G is easily managed. Therefore, it is easy to manage the extent to bury the second conveying screw 23*b*2 in the preset developer G in the upside-down posture of the developing device 23, and the above-described effects are reliably attained.

Figure 10:
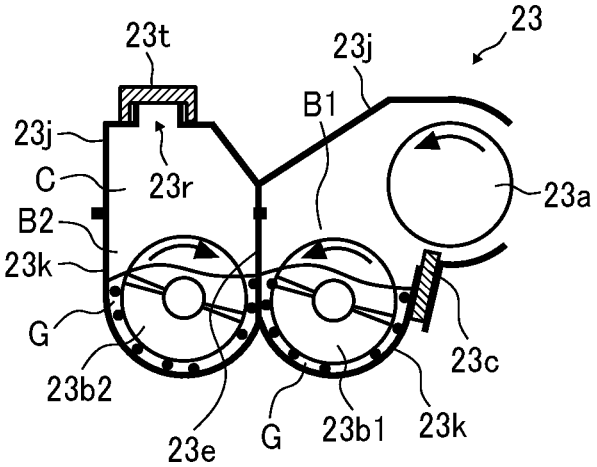
FIG. 10 is a schematic cross-sectional view of a developing device in operation in the image forming apparatus according to a third variation.

FIG. 10 is a schematic cross-sectional view of a developing device 23 in operation in the image forming apparatus 1 according to a third variation and corresponds to FIG. 4 in the above-described embodiment.

As illustrated in FIG. 10, in the developing device 23 according to the third variation, a second seal 23*t* is a lid made of a resin material with a certain thickness to seal the opening 23*r* through which the preset developer G is poured. The second seal (the lid) 23*t* engages with an edge of the opening 23*r* that projects upward from the upper surface of the upper casing 23*j*. A sealant is pasted on the inner wall of the lid-shaped second seal 23*t*. When the second seal 23*t* engages with the edge of the opening 23*r*, the sealant fills a gap between the second seal 23*t* and the edge of the opening 23*r*, thereby preventing the preset developer G from leaking through the gap.

In this way, when the lid is used as the second seal 23*t*, the strength and durability of the second seal 23*t* can be enhanced, and the removability and reuse of the second seal 23*t* can be improved.

As described above, the developing device 23 according to the present disclosure includes the first and second seals 23*s* and 23*t* as seals to seal the space that contains the developer G inside the developing device 23 to form the closed space S. The first and second seals 23*s* and 23*t* are detachable from the developing device 23. The preset developer (the developer) G is stored in the closed space S that is formed by the first and second seals 23*s* and 23*t* and composed of the first and second conveyance paths B1 and B2 and the upper space C. The second conveying screw 23*b*2 is partially or entirely buried in the preset developer G in both of the normal posture and the upside-down posture to which the developing device 23 is flipped from the normal posture. Further, the closed space S gradually spreads from the top of the ceiling 23*jc* of the closed space S toward the bottom of the developing device 23 in the normal posture of the developing device 23.

As a result, when the first seal 23*s* is detached to use the developing device 23, if the preset developer G agglomerates in the closed space S, an inconvenience that the preset developer G is not entirely distributed inside the developing device 23 can be minimized.

Therefore, according to the present disclosure, a developing device, a process cartridge, and an image forming apparatus can be provided, in which an inconvenience that a developer is not entirely distributed in the developing device is unlikely to occur even if the developer agglomerates in a closed space, in which the developer is preset, when a seal is detached.

In the embodiments described above, the process cartridge 20 includes the developing device 23. Alternatively, the developing device 23 can be removably installed in the image forming apparatus 1 as a single unit separated from the process cartridge 20.

In such a configuration, similar effects to those of the above-described embodiments are also attained.

It is to be noted that the term "process cartridge" used in the present disclosure means a removable device (a removable unit) including an image bearer and at least one of a charging device to charge the image bearer, a developing device to develop latent images on the image bearer, and a cleaning device to clean the image bearer, that are united together, and is designed to be removably installed as a united part in the image forming apparatus.

Further, in the above-described embodiments, the present disclosure is applied to the developing device 23 in which the first and second conveying screws (the conveyors) 23*b*1 and 23*b*2 are arranged in parallel in the horizontal direction, and the doctor blade 23*c* is disposed below the developing roller 23*a*. The configuration of the developing device to which the present disclosure is applied is not limited to the above-described configurations. The present disclosure can be applied to other developing devices such as a developing device in which three or more conveyors are arranged in parallel in the horizontal direction, a developing device in which multiple conveyors are arranged in parallel in the vertical direction, and a developing device in which the doctor blade 23*c* is disposed above the developing roller.

Further, the descriptions above concern the developing device 23 that contains the two-component developer G including toner and carrier. However, the present disclosure is applicable to a developing device containing a one-component developer (i.e., toner, which can include additives).

In such configurations, effects similar to those described above are also attained.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. The number, position, and shape of the components described above are not limited to those embodiments described above. Desirable number, position, and shape can be determined to perform the present disclosure.

It is to be noted that the normal posture of the developing device in the vertical direction in the present disclosure means a posture in the vertical direction when the developing device is installed in the image forming apparatus.

What is claimed is:

1. A developing device installable in and removable from an image forming apparatus, the developing device comprising:

a developer bearer opposed to an image bearer of the image forming apparatus and configured to bear a developer and develop a latent image formed on a surface of the image bearer;

a first conveyor opposed to the developer bearer, configured to convey and stir the developer in a first conveyance path;

a second conveyor opposed to the first conveyor, configured to convey and stir the developer in a second conveyance path;

a casing including a ceiling, configured to contain the developer, the developer bearer, the first conveyer, and the second conveyor;

a first seal detachable from the developing device, configured to seal between the developer bearer and the first conveyor or seal a communication opening by which the first conveyance path and the second conveyance path communicate with each other; and a second seal configured to seal an opening in the ceiling above the second conveyor to form a closed space with the first seal that encloses the developer contained in the developing device, the second conveyor configured to be partially or entirely buried in the developer enclosed in the closed space in both of a normal posture of the developing device and an upside-down posture of the developing device to which the developing device is flipped from the normal posture, and a portion of the ceiling directly above at least a portion of the second conveyor declines at an angle such that a cross-sectional area of the closed space in a horizontal plane gradually increases from the ceiling of the casing toward a bottom of the developing device in the normal posture of the developing device.

2. The developing device according to claim 1, wherein a part or all of the ceiling has an inclined surface.

3. The developing device according to claim 2, further comprising:

a partition disposed between the first conveyor and the second conveyor to separate the first conveyance path from the second conveyance path, wherein the closed space includes an upper space disposed above the second conveyance path, and the inclined surface defines an upper end of the upper space.

4. The developing device according to claim 3, wherein the opening extends in the ceiling in a longitudinal direction of the developing device.

5. The developing device according to claim 1, wherein the second seal seals the opening after the inside of the casing has been filled with the developer through the opening in a state in which the first seal is attached to the developing device, and wherein the first seal is detached from the developing device when the developing device starts to be used.

6. The developing device according to claim 4, wherein the first seal is a sheet, and the second seal is a sheet or a lid.

7. A process cartridge comprising:

the developing device according to claim 1; and the image bearer united with the developing device as a single unit, wherein the process cartridge is installable in and removable from the image forming apparatus.

8. An image forming apparatus comprising:

the developing device according to claim 1; and the image bearer opposed to the developing device.

* * * * *